US012577713B2

(12) United States Patent
Sun et al.

(10) Patent No.: US 12,577,713 B2
(45) Date of Patent: Mar. 17, 2026

(54) METHOD FOR PRODUCING THREE-DIMENSIONAL FILAMENT MATS BY MACHINE HEAD AND MOULD PLATE CROSS- GRIDDING RECIPROCATING MOTION AND APPARATUS THEREOF

(71) Applicant: DALIAN PLASTICS RESEARCH INSTITUTE CO., LTD., Dalian (CN)

(72) Inventors: Chenglun Sun, Dalian (CN); Jian Wang, Dalian (CN); Chunming Song, Dalian (CN); Xiaochuan Song, Dalian (CN); Jinghang Chi, Dalian (CN)

(73) Assignee: DALIAN PLASTICS RESEARCH INSTITUTE CO., LTD., Dalian (CN)

( * ) Notice: Subject to any disclaimer, the term of this patent is extended or adjusted under 35 U.S.C. 154(b) by 177 days.

(21) Appl. No.: 18/555,818

(22) PCT Filed: May 17, 2022

(86) PCT No.: PCT/CN2022/093338
§ 371 (c)(1),
(2) Date: Oct. 17, 2023

(87) PCT Pub. No.: WO2023/005363
PCT Pub. Date: Feb. 2, 2023

(65) Prior Publication Data

US 2024/0200246 A1 Jun. 20, 2024

(30) Foreign Application Priority Data

Jul. 26, 2021 (CN) ..... 202110844597.8

(51) Int. Cl.
*D04H 3/04* (2012.01)
*D04H 3/007* (2012.01)
*D04H 3/009* (2012.01)

(52) U.S. Cl.
CPC ..... *D04H 3/04* (2013.01); *D04H 3/007* (2013.01); *D04H 3/009* (2013.01);
(Continued)

(58) Field of Classification Search
None
See application file for complete search history.

(56) References Cited

U.S. PATENT DOCUMENTS

2002/0168906 A1 11/2002 Schlossnikl et al.
2015/0224739 A1 8/2015 Joo et al.
2021/0388535 A1* 12/2021 Ramaratnam ..... D04H 1/14

FOREIGN PATENT DOCUMENTS

CA 2020436 A1 1/1991
CA 2239383 A1 7/1997
(Continued)

OTHER PUBLICATIONS

Bingru Jia CN101780711A English Translation 2010 (Year: 2010).*

*Primary Examiner* — Jacob T Minskey
*Assistant Examiner* — Adrien J Bernard
(74) *Attorney, Agent, or Firm* — Muncy, Geissler, Olds & Lowe, P.C.

(57) ABSTRACT

The present invention provides a method for preparing three-dimensional filament mats by machine head and mould plate cross-gridding reciprocating motion and an apparatus thereof. According to a gridding effect, one row of filament tows, among a plurality of rows of filament tows, are swung leftward and another row of filament tows adjacent to said row are swung rightward to form a diamond-shaped grid layout in the air. When the diamond-shaped grid layout falls on a rotating forming roll (13), diamond-shaped grid nodes are bonded and cured, so that the overall structure of a three-dimensional filament mat becomes a uniformly regular cross-grid structure. Therefore, the transverse strength of a product is controlled, raw materials are
(Continued)

reduced, energy consumption is reduced, and the market competitiveness of the product is improved.

3 Claims, 3 Drawing Sheets

(52) U.S. Cl.
CPC .... *D10B 2321/022* (2013.01); *D10B 2331/02* (2013.01); *D10B 2401/063* (2013.01)

(56) References Cited

FOREIGN PATENT DOCUMENTS

| | | | |
|---|---|---|---|
| CN | 101721854 | A | 6/2010 |
| CN | 101780711 | A | 7/2010 |
| CN | 102191627 | A | 9/2011 |
| CN | 212560656 | U | 2/2021 |
| CN | 112481835 | A | 3/2021 |
| CN | 112501785 | A | 3/2021 |
| CN | 113103611 | A | 7/2021 |
| CN | 113106634 | A | 7/2021 |
| CN | 113122936 | A | 7/2021 |
| CN | 113529282 | A | 10/2021 |
| GB | 1042135 | A | 9/1966 |
| JP | 3034513 | B1 | 4/2000 |
| WO | WO-2013052371 | A2 | 4/2013 |

* cited by examiner

M-M

METHOD FOR PRODUCING THREE-DIMENSIONAL FILAMENT MATS BY MACHINE HEAD AND MOULD PLATE CROSS- GRIDDING RECIPROCATING MOTION AND APPARATUS THEREOF

TECHNICAL FIELD

The present invention relates to the technical field of filament mat forming, particular to a method for producing a three-dimensional filament mat by machine head and mould plate cross-gridding reciprocating motion and an apparatus thereof.

BACKGROUND

At present, the production process of plastic filament mats with a three-dimensional or plane structure generally adopts that the extruded plasticized melt is sprayed through a mold and a filament plate to form multiple tows of molten plastic filaments which fall on a forming mould or a shaping mould for forming or shaping. In this way, due to the rotation and stripping direction of the forming roll or the shaping roll is the longitudinal direction of the product, the longitudinal overlapping nodes between the filaments are obviously more than the transverse overlapping nodes, causing the longitudinal strength of the product is multiple times higher than the transverse strength. The weak transverse strength of the product is a main factor that seriously affects the comprehensive strength of products.

In the manufacturing process of polymer three-dimensional (including plane structure) filament mat, in order to meet the balance of overlapping nodes in the longitudinal direction and transverse direction of the product, that is, to ensure that the tensile strength in both directions is relatively consistent, the latest technical method currently adopted is to use a fixed machine head and mould plate to extrude filament tows, then the filament tows form a product in a forming apparatus swinging from side to side. There is no fixed forming apparatus which modifies original machine head and mould plate structure to make the apparatus reciprocate.

SUMMARY OF THE INVENTION

In order to overcome the shortcomings in the prior art, the present invention provides a method for producing three-dimensional filament mats by machine head and mould plate cross-gridding reciprocating motion and an apparatus thereof, which can make multiple rows of filament tows to form a diamond-shaped grid layout in the air according to a gridding effect, that is, a row of filament tows swings leftward and another row of filament tows adjacent thereto swings rightward, then the filament tows fall onto a rotating forming roll, so that the overall structure of the three-dimensional filament mat becomes a uniformly regular cross-grid structure after the diamond-shaped grid nodes are bonded and cured.

The present invention adopts the following technical solutions:

For a method for producing a three-dimensional filament mat by machine head and mould plate cross-gridding reciprocating motion, a plastic raw material is plasticized by an extruder, and the plasticized material enters a machine head and a distribution plate from a general flow channel, passes through a flow channel in each row of single mould plate of a combined swing odd-even mould plate and flows into a collection guide groove for temporary storage, and then passes through a tow outlet to uniformly extrude a filament tow: During the extrusion process, odd-numbered rows and even-numbered rows of the combined swing odd-even mould plate regularly swing leftward and rightward respectively, so that the filament tows form a regular diamond-shaped grid layout which falls onto a rotating forming roll, and the three-dimensional filament mat is formed after cooling and curing.

Further, the plastic raw material is nylon or PP (polypropylene).

Further, the combined swing odd-even mould plate includes odd-numbered single mould plates and even-numbered single mould plates. The odd-numbered single mould plates swing leftward while the even-numbered single mould plates swing rightward.

The present invention also provides an apparatus of machine head and mould plate cross-gridding reciprocating motion for producing a three-dimensional filament mat. The machine head is fixedly connected to the extruder by means of the flow channel, an upper end of the machine head is connected to the distribution plate, and the mould plate under the distribution plate is a split combined structure. A left swing device and a right swing device are respectively fixed on both sides of the machine head. The two swing devices separately drive a corresponding mould plate to swing leftward and rightward along a bottom groove of the machine head, and the bottom groove is mechanically sealed with the machine head.

Further, the mould plate is a combined swing odd-even mould plate. The combined swing odd-even mould plate is provided with multiple rows of single mould plates, where the odd-numbered single mould plates are connected in a comb shape, and the even-numbered single mould plates are connected in a comb shape.

Further, each row of single mould plate is provided with the flow channel inside, and the collection guide groove is disposed perpendicular to the flow channel. The collection guide groove is provided with a plurality of tow outlets, and a distance between every two adjacent tow outlets in the same row is equal or unequal.

Further, a number of the single mould plates of the combined swing odd-even mould plate is 2 to 12 rows.

Further, a distance between every two adjacent single mould plates of the combined swing odd-even mould plate is equal or unequal.

Further, the left swing device and the right swing device are each independently selected from hydraulic cylinder, pneumatic cylinder and mechanical crank structure, which change an angle and a shape of a cross-grid of a product by changing a driving stroke.

Further, the distribution plate is provided with a bottom groove connecting piece. The combined swing odd-even mould plate is connected to the distribution plate by means of the bottom groove connecting piece.

Compared with the prior art, the present invention has the following beneficial effects:

During the forming process of the filament mat, there is almost no loss in longitudinal strength, while the transverse strength is doubled, so that the longitudinal and transverse forces of the product are basically balanced, which solves the problem that have to increase the weight of the product to improve its transverse force, saves raw materials, greatly reduces energy consumption, and improves the market competitiveness of the product. The present invention has significant social and economic benefits.

DETAILED DESCRIPTION OF DRAWINGS

Figure 1:
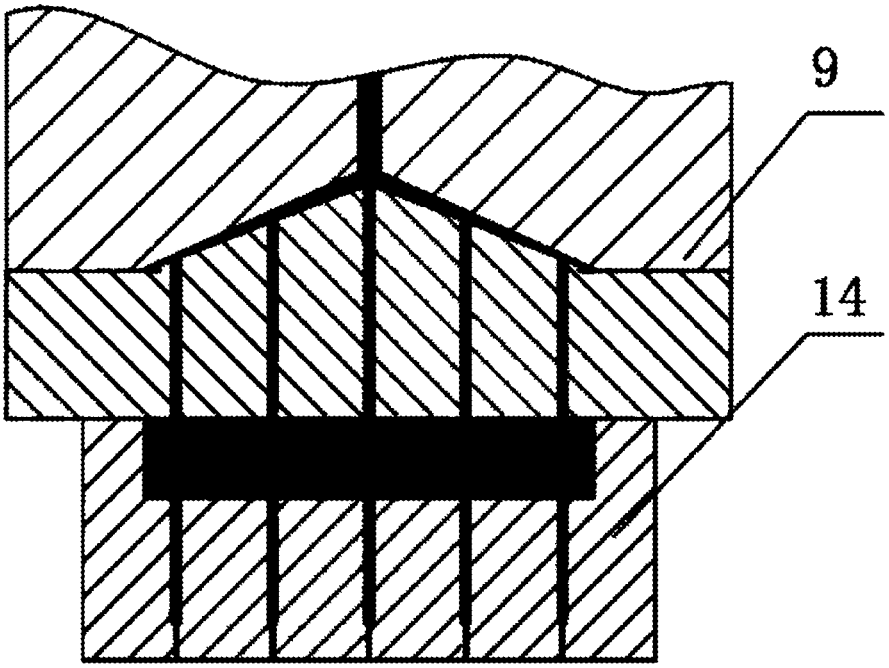
FIG. 1 shows a schematic diagram of an integrated fixed mould plate in the prior art.

In the figures: 1. single mould plate of row 1, 2. single mould plate of row 2, 3. single mould plate of row 3, 4. single mould plate of row 4, 5. single mould plate of row 5, 6. odd-numbered single mould plate; 7. even-numbered single mould plate, 8. combined swing odd-even mould plate, 9. machine head, 10. extruder, 11. left swing device, 12. right swing device, 13. forming roll, 14. integrated fixed mould plate, 15. collection guide groove, 16. tow outlet, 17. flow channel, 18. distribution plate, 19. bottom groove connecting piece.

DETAILED DESCRIPTION OF PREFERRED EMBODIMENTS

The present invention is further described below with reference to embodiments, but is not limited the protection scope of the present invention in any way. Unless otherwise specified, the experimental methods adopted in the present invention are conventional methods, and the experimental equipment, materials, additives and the like used in the present invention can be commercially available.

Embodiment 1

Figure 2:
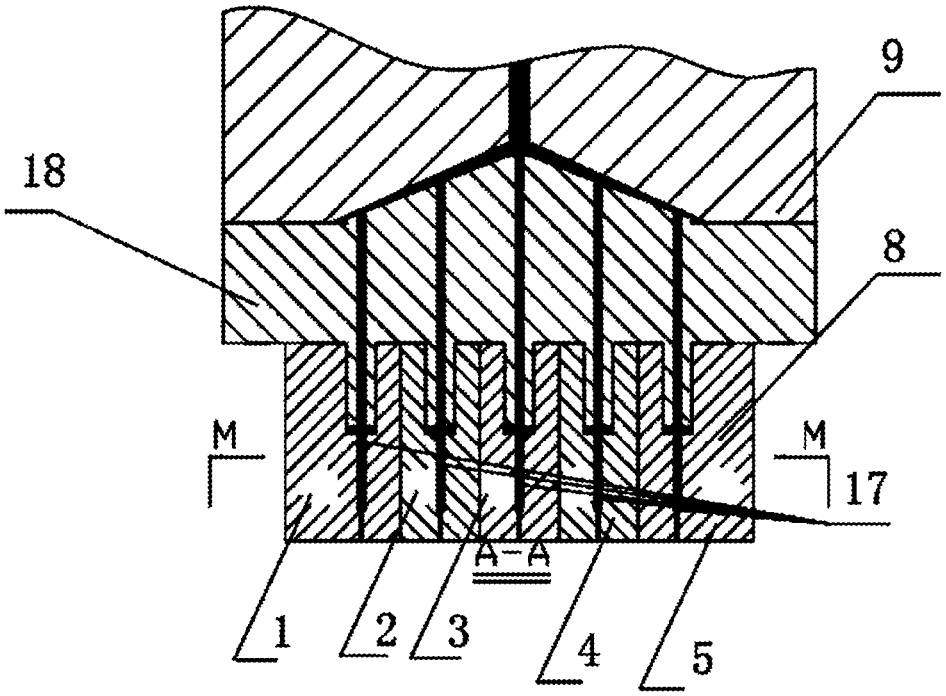
FIG. 2 shows a schematic diagram I of a combined swing odd-even mould plate of the present invention.
Figure 3:
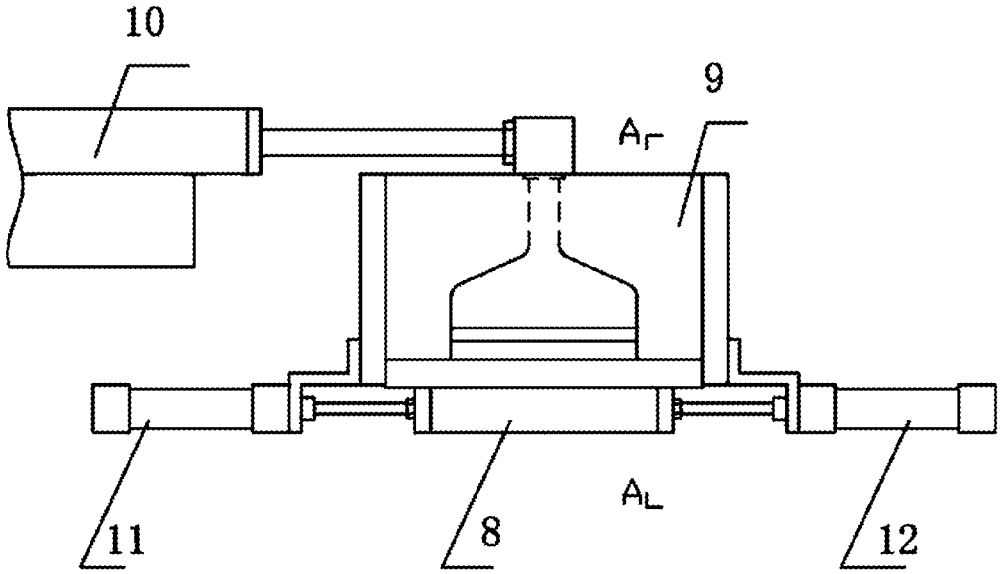
FIG. 3 shows a schematic diagram of an apparatus with machine head and mould plate corss-gridding reciprocating motion for producing a three-dimensional filament mat.
Figure 4:
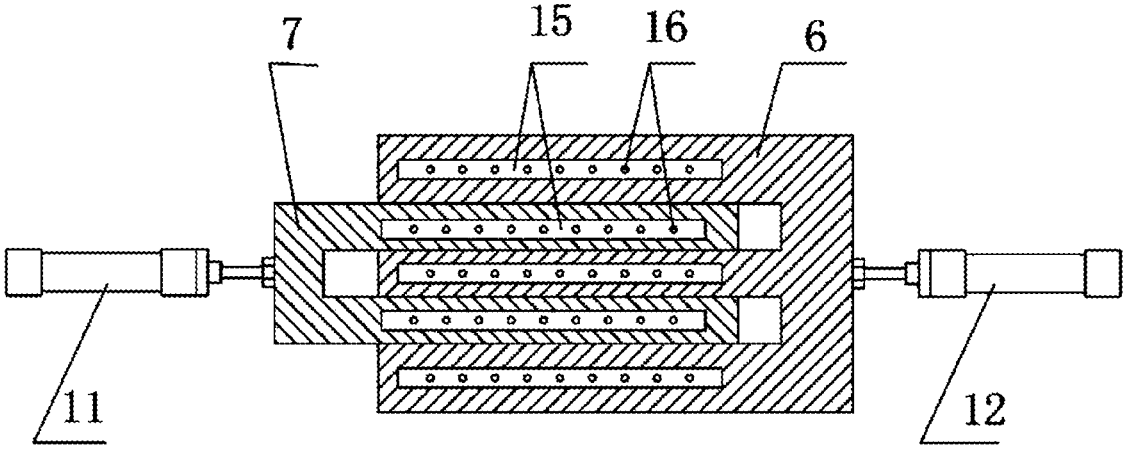
FIG. 4 shows a structural schematic diagram of a combined swing odd-even mould plate motion.

As shown in FIG. 1, at present, the mould plate used in the prior art is an integrated fixed mould plate 14, which is immovable. The mould plate used in the present invention is a split combined structure which is movable, that is, a combined odd-even swing mould plate 8 as shown in FIG. 2.

The machine head 9 is fixedly connected to the extruder 10 by means of the flow channel. An upper end of the machine head 9 is connected to the distribution plate 18, and the mould plate under the distribution plate 18 is a split combined structure. A left swing device 11 and a right swing device 12 are respectively fixed on both sides of the machine head 9, the two swing devices separately drive a corresponding mould plate to swing leftward and rightward along a bottom groove of the machine head 9, and the bottom groove is mechanically sealed with the machine head 9.

The mould plate is a combined swing odd-even mould plate 8 which is provided with 2 to 12 rows of single mould plates. The odd-numbered single mould plates 6 are connected in a comb shape and the even-numbered single mould plates 7 are connected in a comb shape. A distance between every two adjacent single mould plates is equal or unequal. Each row of single mould plate is provided with the flow channel 17 inside, and the collection guide groove is disposed perpendicular to the flow channel 17. The collection guide groove 15 is provided with a plurality of tow outlets 16, and a distance between every two adjacent tow outlets 16 in the same row is equal or unequal.

The left swing device 11 and the right swing device 12 can be each independently selected from hydraulic cylinder, pneumatic cylinder and mechanical crank structure, which can change an angle and a shape of a cross-grid of a product by changing a driving stroke.

The filament tows extruded by an integrated fixed mould plate 14 in the prior art are vertically downward, which cannot form a cross-gridding structure. An embodiment of the present invention takes a combined swing odd-even mould plate 8 having 5 rows of single mould plates as an example. The combined swing odd-even mould plate 8 is composed of 5 rows of mutually independent single mould plates. Single mould plates of rows 1, 3, and 5 are driven to swing leftward by an independent hydraulic cylinder, while single mould plates of rows 2 and 4 are driven to swing rightward by another independent hydraulic cylinder. During the swing process, the single mould plates of rows 1 to 5 extrude filament tows to form a cross-gridding filament mat.

Embodiment 2

The plastic raw material is plasticized by the extruder 10. The plasticized material enters the machine head 9 from a main flow channel, passes through the flow channel 17 in each row of single mould plate of the combined swing odd-even mould plate 8 and flows into a collection guide groove 15 for temporary storage, and then passes through a tow outlet 16 to uniformly extrude a filament tow: During the extrusion process, the odd-numbered rows and even-numbered rows of the combined swing odd-even mould plate 8 regularly swing leftward and rightward respectively, so that the filament tows form a regular diamond-shaped grid layout which falls onto a rotating forming roll 13 and a three-dimensional filament mat is produced after cooling and curing.

Each row of filament tows arranged in the left and right directions of the head 9 is extruded by the mutually independent single mould plate of row 1, single mould plate of row 2, single mould plate of row 3, single mould plate of row 4 and single mould plate of row 5 during the swing process, that is, all the odd-numbered rows of filament tows are extruded by the odd-numbered single mould plates 6, and all the even-numbered rows of filament tows are extruded by the even-numbered single mould plates 7. The odd-numbered single mould plates 6 and the even-numbered single mould plates 7 swing in opposite directions at the same time.

Figure 5:
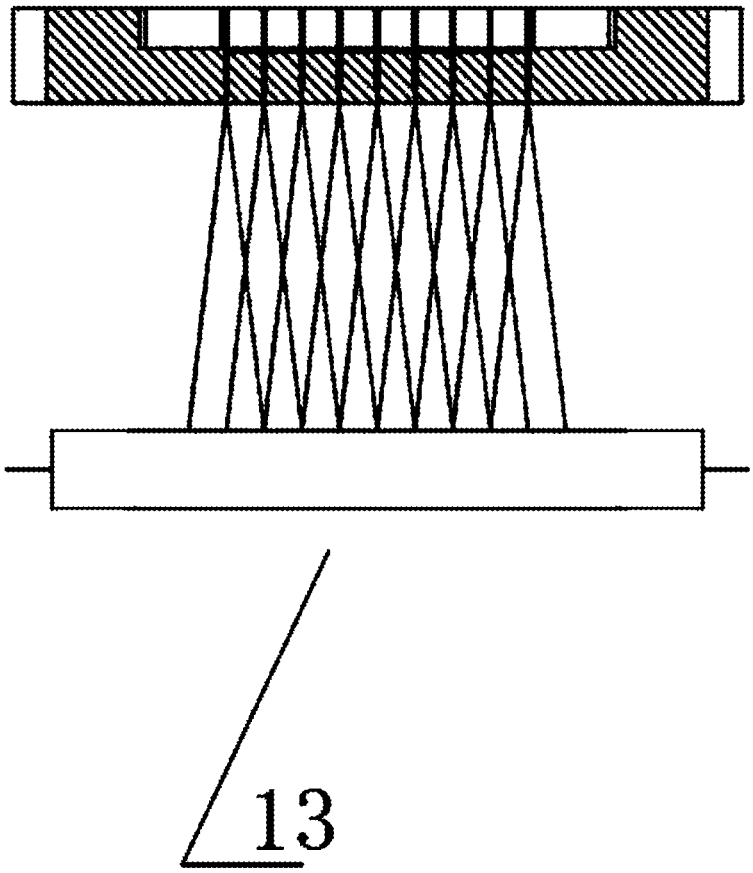
FIG. 5 shows a schematic diagram of an overlapping pattern of the cross grids in the air.
Figure 6:
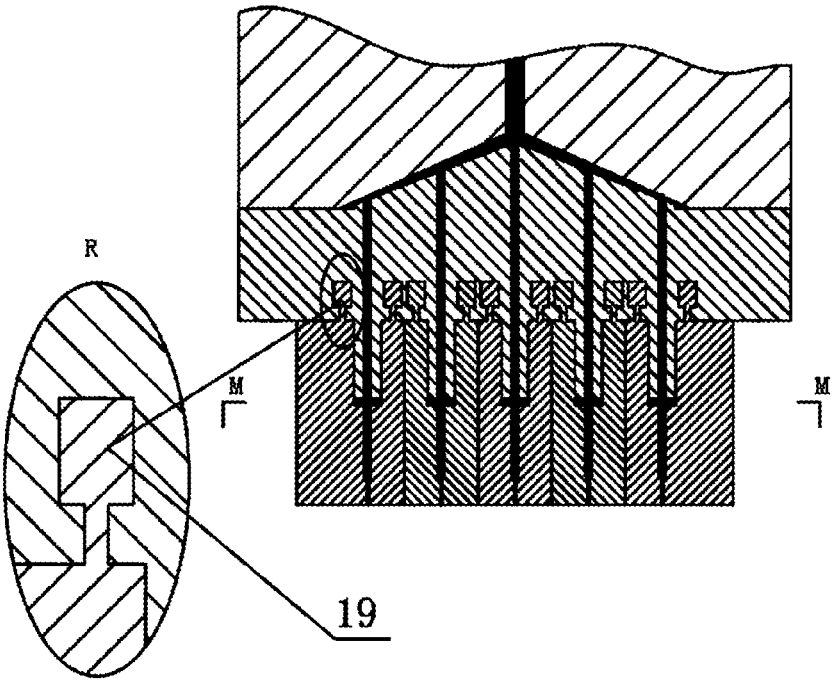
FIG. 6 shows a schematic diagram II of a combined swing odd-even mould plate of the present invention.

When the odd-numbered rows of filament tows move leftward through the odd-numbered single mould plate 6, the moving trajectory of the filament tows is titled to the upper left. Meanwhile, when the even-numbered rows of filament tows move rightward through the even-numbered single mould plate 7, the moving trajectory of the filament tows is titled to the upper right. The shape of the odd-numbered and even-numbered rows of filament tows combining and stacking in the air is a cross-gridding shape. When the combined and stacked filament tows fall on the rotating forming roll 13, the shape and nodes of cross-grid can be cured and mold, as shown in FIG. 5.

Embodiment 3

Different form Embodiment 1, the distribution plate 18 is provided with a bottom groove connecting piece 19, and the combined swing odd-even mould plate 8 is connected to the distribution plate 18 by means of the bottom groove connecting piece 19.

Embodiment 4

The raw material used in the present invention is nylon or PP. The raw material is plasticized by the extruder 10, the molten raw material is fed into the machine head 9 through the flow channel, and then extruded by the combined swing odd-even mould plate 8 to obtain filament tows with a regular cross-gridding structure, followed by falling onto the rotating forming roll 13 to cure and mold.

Taking nylon as an example, the parameters of the present invention are as follows:

Raw material: Nylon 6

Specification of the filament mat product: 450 g/m$^2$

Test results of the product produced by a conventional production process of the existing technology are as follows:

Longitudinal force: 1.60 KN/m, and

Transverse force: 0.83 KN/m.

Test results of the product produced by the present invention are as follows:

Longitudinal force: 1.72 KN/m, and

Transverse force: 1.76 KN/m.

Note: The longitudinal force and transverse force are both tensile fracture strength values.

It can be seen from the test results that, for the product prepared by the apparatus and the method for preparing three-dimensional filament mats by machine head and mould plate cross-gridding reciprocating motion in the present invention, the longitudinal strength thereof basically does not change and the transverse strength is doubled, so that the longitudinal and transverse forces of the product are basically balanced, which solves the problem that have to increase the weight of the product to improve its transverse force to enable the product to meet standards, saving raw materials.

The above implementation methods are only the preferred embodiments of the present invention, not all the possible embodiments of the present invention. For those ordinary skilled in the art, any obvious changes made to the present invention without deviating from the principle and spirit of the present invention should be considered to be included in the scope of protection of the claims of the present invention.

What is claimed is:

1. A method for producing a three-dimensional filament mat by machine head and mould plate cross-gridding reciprocating motion, wherein a plastic raw material is plasticized by an extruder, the plasticized material enters a machine head and a distribution plate from a general flow channel, passes through a flow channel in each row of single mould plate of a combined odd-even mould plate and flows into a collection guide groove for temporary storage, then passes through a tow outlet to uniformly extrude a filament tow, during an extrusion process, an odd-numbered single mould plate and an even-numbered single mould plate of the combined odd-even mould plate regularly move leftward and rightward, respectively, so that the filament tows form a regular diamond-shaped mesh which falls onto a rotating forming roll, and the three-dimensional filament mat is formed after cooling and curing, wherein, a left swing device fixed on the left side of the machine head drives the even-numbered single mould plate to move leftward and rightward along a bottom groove of the machine head, and a right swing device fixed on the right side of the machine head drives the odd-numbered single mould plate to move leftward and rightward along the bottom groove of the machine head, and the bottom groove is mechanically sealed with the machine head.

2. The method for producing a three-dimensional filament mat by machine head and mould plate cross-gridding reciprocating motion according to claim 1, wherein the plastic raw material is nylon or PP.

3. The method for producing a three-dimensional filament mat by machine head and mould plate cross-gridding reciprocating motion according to claim 1, wherein the combined odd-even mould plate comprises odd-numbered single mould plates and even-numbered single mould plates, wherein the odd-numbered single mould plates move leftward/rightward while the even-numbered single mould plates move rightward/leftward.

* * * * *